US007717984B1

(12) United States Patent
Schreiber

(10) Patent No.: US 7,717,984 B1
(45) Date of Patent: May 18, 2010

(54) ELECTROSTATIC PRECIPITATOR UNIT

(76) Inventor: Mark Michael Schreiber, 7140 Northland Dr., Brooklyn Park, MN (US) 55428

( * ) Notice: Subject to any disclaimer, the term of this patent is extended or adjusted under 35 U.S.C. 154(b) by 188 days.

(21) Appl. No.: 12/069,382

(22) Filed: Feb. 11, 2008

(51) Int. Cl.
*B03C 3/47* (2006.01)

(52) U.S. Cl. ..... 96/30; 96/39; 96/40; 96/41; 96/86; 96/94

(58) Field of Classification Search ..... 96/26, 96/29, 30, 39–41, 84–88, 94
See application file for complete search history.

(56) References Cited

U.S. PATENT DOCUMENTS 3,041,807 A * 7/1962 Getzin et al. ..... 96/86
3,362,134 A * 1/1968 Wiemer ..... 96/26
3,504,482 A * 4/1970 Goettl ..... 96/18
4,117,255 A * 9/1978 Kawaike et al. ..... 96/50
4,290,788 A * 9/1981 Pittman et al. ..... 96/86
4,439,216 A * 3/1984 Perryman ..... 96/26
5,679,137 A * 10/1997 Erdman et al. ..... 96/26
7,244,289 B2 * 7/2007 Su ..... 96/39
7,258,715 B2 * 8/2007 Cox et al. ..... 55/422
7,351,274 B2 * 4/2008 Helt et al. ..... 95/2
7,413,594 B2 * 8/2008 Paterson et al. ..... 95/2
7,547,352 B2 * 6/2009 Paterson et al. ..... 96/39
2005/0051028 A1 * 3/2005 Botvinnik ..... 96/88
2008/0028937 A1 * 2/2008 Paterson et al. ..... 96/81
2008/0314250 A1 * 12/2008 Cowie et al. ..... 96/86

FOREIGN PATENT DOCUMENTS

JP 59-134440 A * 8/1984 ..... 96/26

* cited by examiner

*Primary Examiner*—Richard L Chiesa

(57) ABSTRACT

An electrostatic precipitator unit used for the removal of coolant liquid and particles generated by a machine tool includes an electrostatic precipitator cell. The electrostatic precipitator cell includes power and collector ground fins and an ionizer grid positioned below the fins. The lower edges of the power fins are spaced above the collector ground fins to prevent contact of the liquid on the ground fins with the power fins. An electrical contact assembly for supplying electrical current to the ionizer grid and power fins is electrically isolated from all ground contacts by dielectric standoffs which define an insulating air gap. The likelihood of liquid tracking to ground is therefore eliminated.

11 Claims, 5 Drawing Sheets

ELECTROSTATIC PRECIPITATOR UNIT

FIELD OF INVENTION

This invention relates to electrostatic precipitator units which are electrically constructed so as to minimize, if not eliminate, shortening to ground by liquid pathways.

BACKGROUND OF THE INVENTION

Electrostatic precipitator devices are used with machine tools for removing and collecting liquid coolant and particles generated during operation of the machine tool. The electrostatic precipitator may be mounted on the machine tool and coolant and particles are entrained in a stream of air drawn through the electrostatic cell plates where the drops of coolant and particles accumulate and drain downwardly. The electrostatic precipitator device may also be mounted on the floor, ceiling, wall, etc. and ducted to the machine tool.

In conventional electrostatic precipitators the electric contacts to the cell plates or fins and cell ionizer are mounted on dielectric elements to insulate the conductive portion of the contact to ground. However, these contacts are susceptible to tracking by conductive fluid (coolant) to ground. This produces shorting and damage to the cell and loss of performance.

The power and ground fins of the cell are arranged vertically in alternating fashion and the air entrained ionized fluid and particles collect on the ground fins and flow downwardly by action of gravity. As the drops accumulate on the lower edge portions of the ground fins, the coolant drops may grow or agglomerate sufficiently to extend across and engage the adjacent power fins before dropping from the ground plate. This also produces shorting and damage to the cell and loss of performance.

The present invention is directed to improvement of the electrostatic precipitator unit for eliminating these problems.

SUMMARY OF THE INVENTION

An object of this invention is to provide an electrical contact assembly for supplying current to the ionizer and collector fins of an electrostatic precipitator cell for an electrostatic precipitator unit which is insulated from any ground portions of the unit by an air gap thereby minimizing, if not eliminating, shorting to ground by liquid tracking.

Another object of this invention is to provide shortened power fins having their lower edges spaced above the lower edges of adjacent ground fins to avoid globules of coolant at the bottom of the ground fins contacting adjacent power fins.

The electrostatic precipitator unit includes a cabinet containing an electrostatic precipitator cell or cells. The unit is designed to be positioned upon or adjacent a conventional machine tool and communicates with the cutting chamber of the machine tool. When the unit is mounted on the wall, ceiling, etc. adjacent a machine tool, it will be connected to the tool via ducting. A stream of air entrained coolant and particles flows upwardly through the precipitator unit. Ionized coolant and particles collect on the ground plates or fins of the cell. An electrical contact assembly providing high voltage (about up to 4,700 volts DC) current to the collector cell is mounted within the cabinet but isolated from ground by nylon sleeves which provide an electrically insulating air gap which, in effect, eliminates the occurrence of unwanted liquid tracking pathways to ground. One contact of the electrical contact assembly contacts the ionizer bar of the ionizer grid and supplies high voltage (about up to 9,600 volts DC) current thereto. Another contact of the electrical contact assembly contacts the power fins. The power fins have shortened lower edge to prevent tracking across from the adjacent ground fin by agglomerating liquid coolant droplets.

DESCRIPTION OF THE PREFERRED EMBODIMENT

Figure 1:
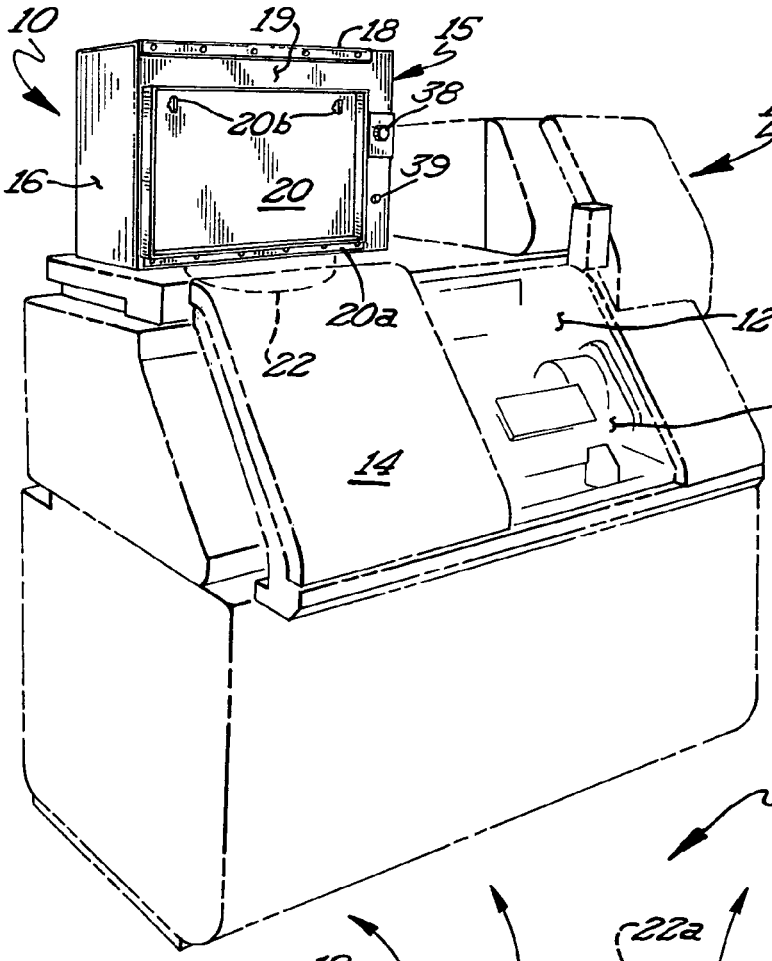
FIG. 1 is a perspective view of the novel electrostatic precipitator unit mounted on a machine tool.

The novel and improved electrostatic precipitator unit, designated generally by the reference numeral 10, is shown mounted on a machine tool 11. The machine tool 11 may be an automatic screw machine, lathe, metal turning machine or similar type machine tool. The operation of the machine tools are controlled by computer programs in a manner well-known in the industry.

During operation of the machine tool, liquid coolant is sprayed on the work piece in the work area 13 in the chamber 12. Access to the chamber 12 is by way of an access door 14. The electrostatic precipitator unit 10 serves to remove liquid coolant and particles generated during operation of the machine tool 11.

Figure 2:
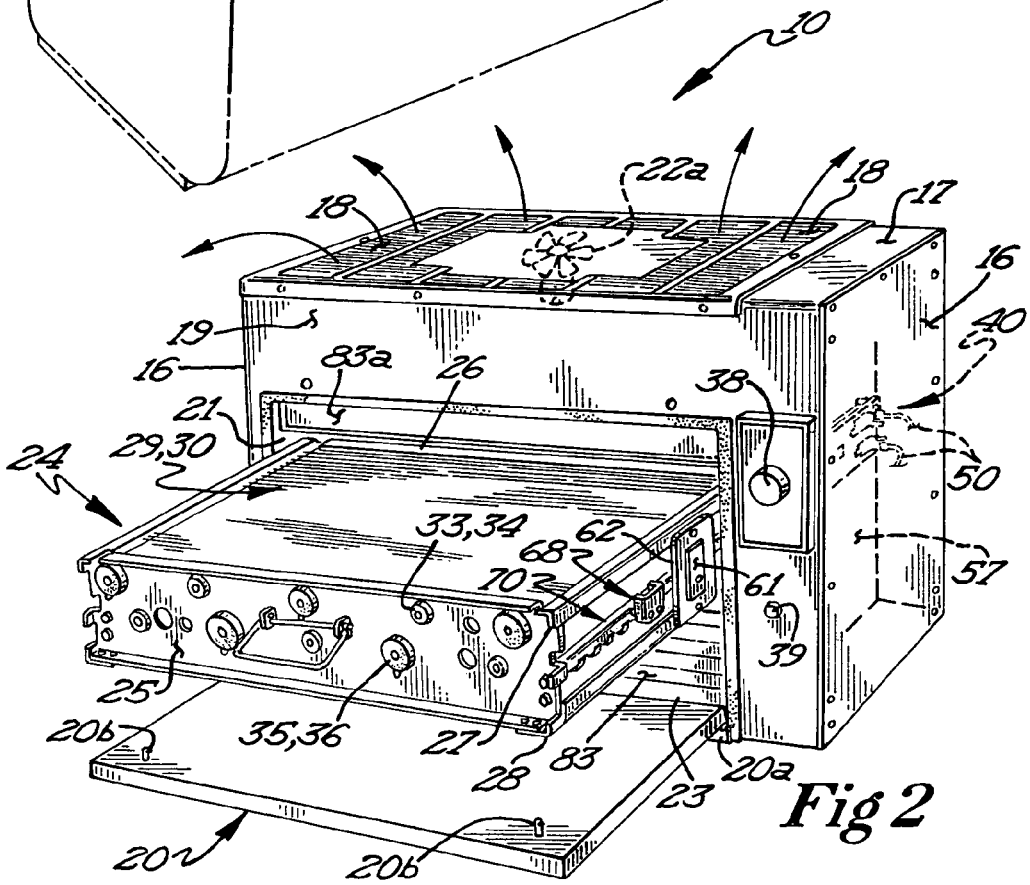
FIG. 2 is a perspective view of a an electrostatic precipitator unit with the access door opened and a an electrostatic precipitator cell withdrawn from the cabinet.

The electrostatic precipitator unit 10 includes a generally rectangular shaped (parallelopiped) cabinet 15 having opposed side walls 16, a top wall 17, a front wall 19 and a rear wall (not shown). The top wall 17 includes a grill 18 to permit air to flow out of the chamber 23 of the cabinet. The bottom wall (not shown) of the cabinet is provided with an inlet opening through which the stream of air-entrained liquid coolant and particles pass. An evacuation impeller or fan 22*a* is mounted in the top portion of the cabinet chamber 23 adjacent the grill 18 and produces an upwardly flowing air stream for entraining the liquid coolant and particles therein as best seen in FIG. 2. Mechanical mist impingers 83 are positioned in the lower portion of the cabinet chamber 23 below the ionizer grid as a first stage for removing substantial quantities of the coolant and particles. In the embodiment shown, the mist impingers 83 have thickness dimension of several inches.

Figure 3:
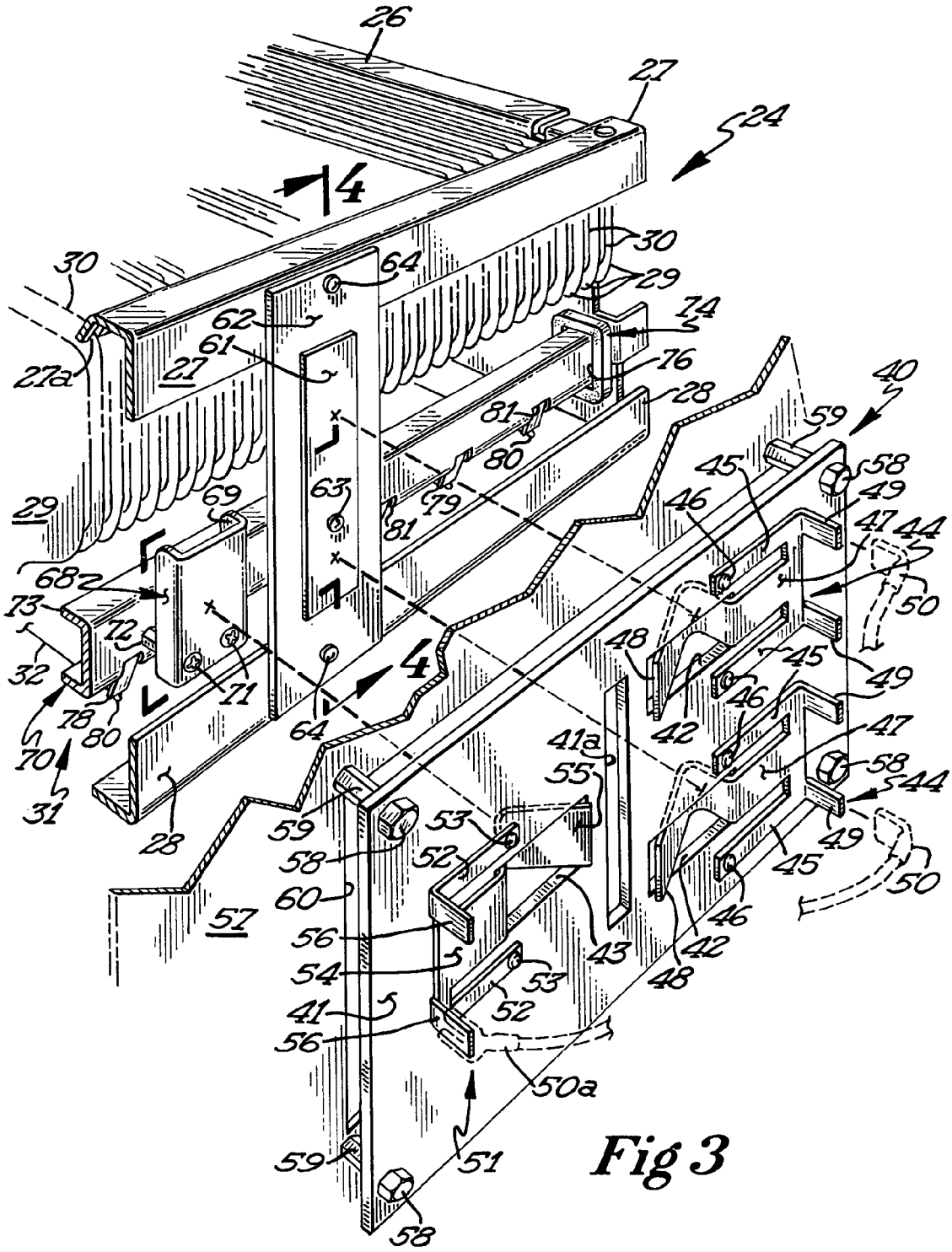
FIG. 3 is a fragmentary, exploded perspective view of a portion of the electrostatic precipitator unit illustrating the novel electrical contact assembly.
Figure 7:
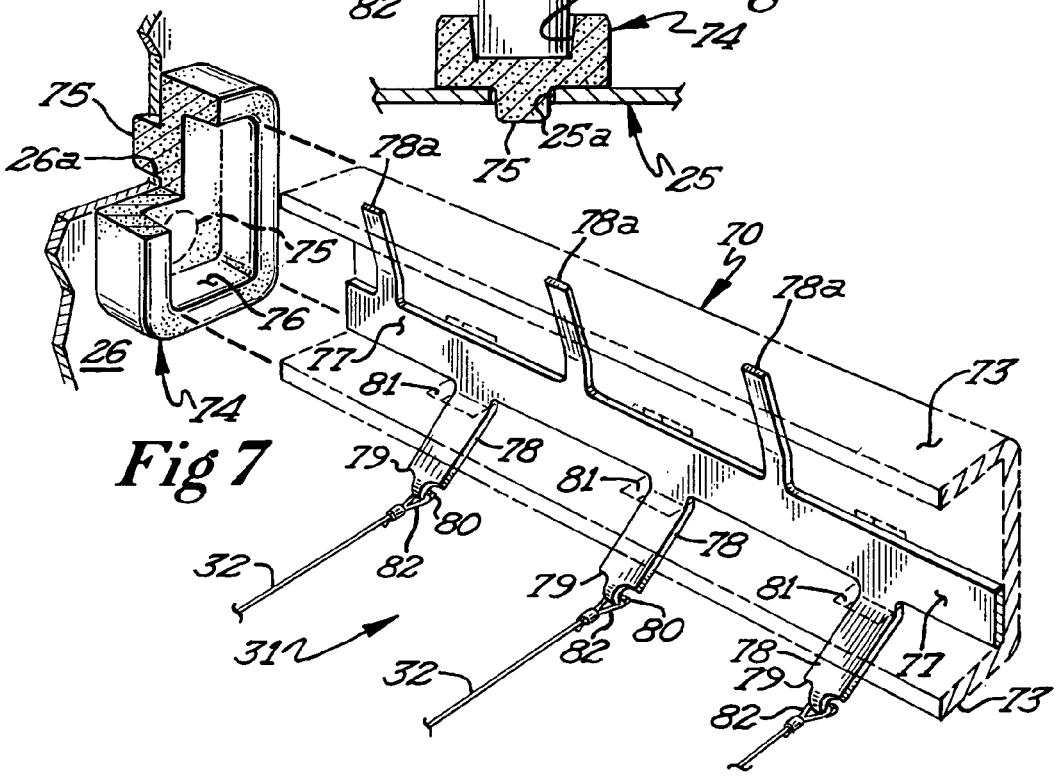
FIG. 7 is a fragmentary perspective view of the bus bar and phosphor-bronze strip engaging the ionizer wires of the ionizer grid.

In the embodiment shown, a single electrostatic precipitator cell 24 is the collector for the coolant and particles, but larger units will use more than one cell. The cell 24 includes a frame comprised of a front wall or plate 25 and a rear wall 26 interconnected by upper side rails 27 and lower side rails 28. The cell is provided with a plurality of identical, vertically disposed ground fins or plates 29 and a plurality of identically disposed power plates or fins 30 as best seen in FIGS. 3 and 7. The power fins and ground fins are arranged in alternate fashion.

Referring again to FIG. 2, it is pointed out that a plurality of rods 33 extend through openings in the front and rear plates of the cell and are supported by rivets and bump offsets 34 in the front and rear walls 25, 26 of the cell. The rods 33 are connected to ground and pass through openings in the ground fins 29 to provide support for the ground fins. The cell 24 is also provided with a plurality of rods 35 extending through the front and rear plates of the cell and through openings in the power fins 30. The rods 35 are supported in ceramic insulators 36 and provide support to the power fins.

The electrostatic precipitator cell 24 is also provided an ionizer grid 31 which is positioned below the ground fins and power fins and includes a plurality of ionizer wires 32. The ionizer grid 31 is diagrammatically shown in FIG. 9. The cell 24 is supported on rails 37 secured in the cabinet chamber 23 to enable the cell to be readily removed from the cabinet. A control knob 38 controls certain electrical circuitry of the unit and an indicator light informs an operator that high voltage power supply is energized and implies the electronic cell is properly functioning. If the indicator light goes out or blinks, this signals an operator that the cell has a short circuit or similar failure requiring service. A post filter 83*a* is positioned above the cell plates or fins and entraps droplets and particles that might remain to assure clean air entering the room.

The foregoing description is of a typical electrostatic precipitator cell. One major problem with commercial electrostatic precipitators is the tracking of conductive fluids from the electrical contacts to ground. Typically, dielectric material is used to mount and insulate the conductive portion of the contact from ground.

Figure 4:
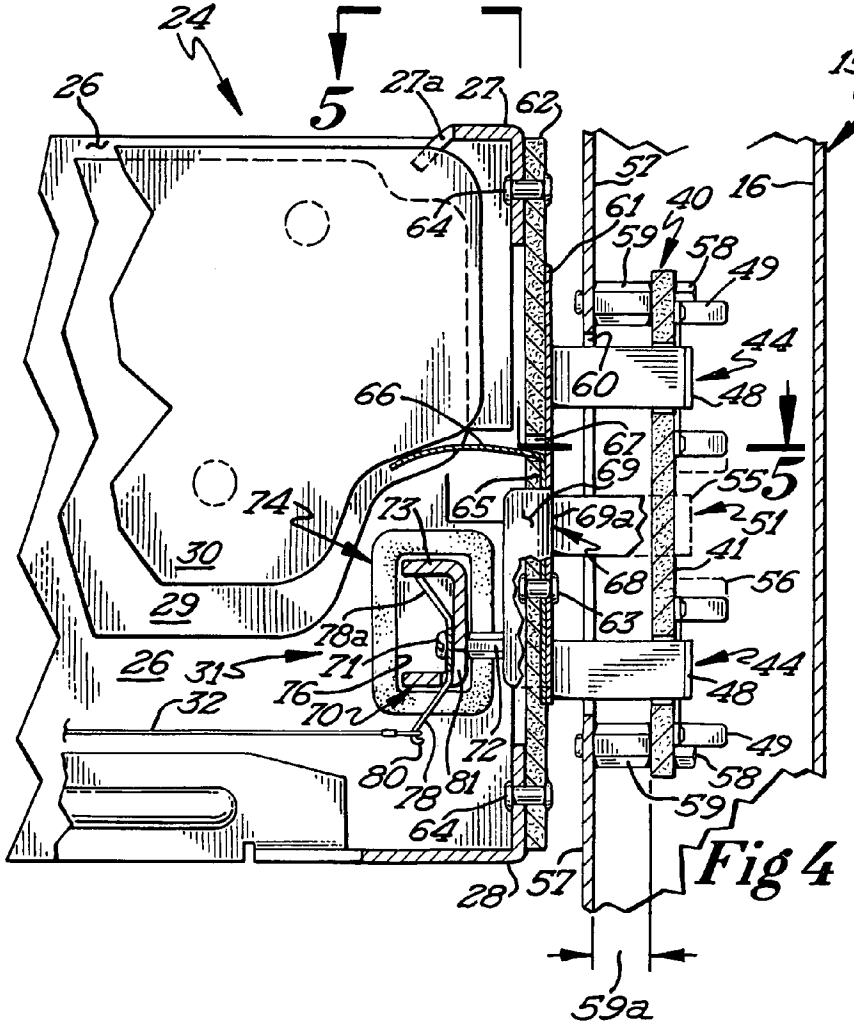
FIG. 4 is a cross-sectional view taken approximately along line 4-4 of FIG. 3 and looking in the direction of the arrows.

Referring now to FIGS. 3 and 4, it will be seen that one embodiment of the novel electrical power contact assembly 40 is there shown. The contact assembly 40 includes a rectangular support member 41 formed of a dielectric material such as fiberglass reinforced thermoset polyester resin or phenolic resin. The support member 41 has a pair of vertically spaced apart rectangular openings 43 in one side portion thereof. Each opening accommodates a portion of an electric contact member 44.

Each contact member 44, which is formed of a spring like conductive material (preferably stainless steel), includes flat, elongate mounting strips 45 which are secured to the support member by fastening elements 46 such as the rivets shown. Each contact member 44 includes a central element 47 spaced from the mounting strips 45 and including a generally v-shaped contact portion 48 projecting through an opening 42. Each contact member 44 has a pair of male socket elements 49 each of which is bent at right angles to and integral with a mounted strip 45. One male socket element 49 of each contact member 44 is engaged by a female socket element 50 that is connected to a source of high voltage electrical current. Although the voltage to the contact member may vary, depending on the application, the voltage may be of the order of up to 4,700 volts.

The contact assembly 40 also includes an identical electric contact member 51 positioned on the other side portion of the support member 41 adjacent the opening 43. The contact member 51 includes a pair of mounting strips 52, secured by rivets or fastening elements 53 to the support member. A central element 54 having a v-shaped contact portion 55 projects through the opening 43. The mounting strips 52 are also provided with male socket elements 56 which are engaged by a female socket element 50*a* connected to a source of high voltage current. In some applications, the voltage may be as high as 9,600 volts.

The electrical contact assembly 40 is mounted on the inner side wall 57 spaced inwardly from the adjacent outer side wall 16 of the cabinet 15. In the embodiment shown, the contact assembly 40 is secured to the inner side wall 57 by nut and bolt assemblies 58. Dielectric plastic standoff sleeves (preferably nylon) 59 surrounds the bolts of the nut and bolt assembly and serves to space the contact assembly from the inner wall 57. The air gap 59*a* defined between the contact assembly and inner side wall 57 isolates the contact assembly to ground. It will be noted that the inner wall 57 has a rectangular shaped opening 60 therein which is only slightly smaller than the mounting member 41 of the contact assembly. This opening 60 spaces the electrical contact members from any surface or edge of the inner wall 57. The air gap 59*a*, dielectric stand off elements 59, and opening 60 substantially eliminates tracking to ground by liquid. The support member 41 also has a vertical opening 41*a* in the mid portion thereof which extends between the contact member 51 and the contact members 44. The opening or slot 41*a* has a width dimension large enough to prevent high voltage sparking from the contact member 51 to the contact members 44.

Figure 5:
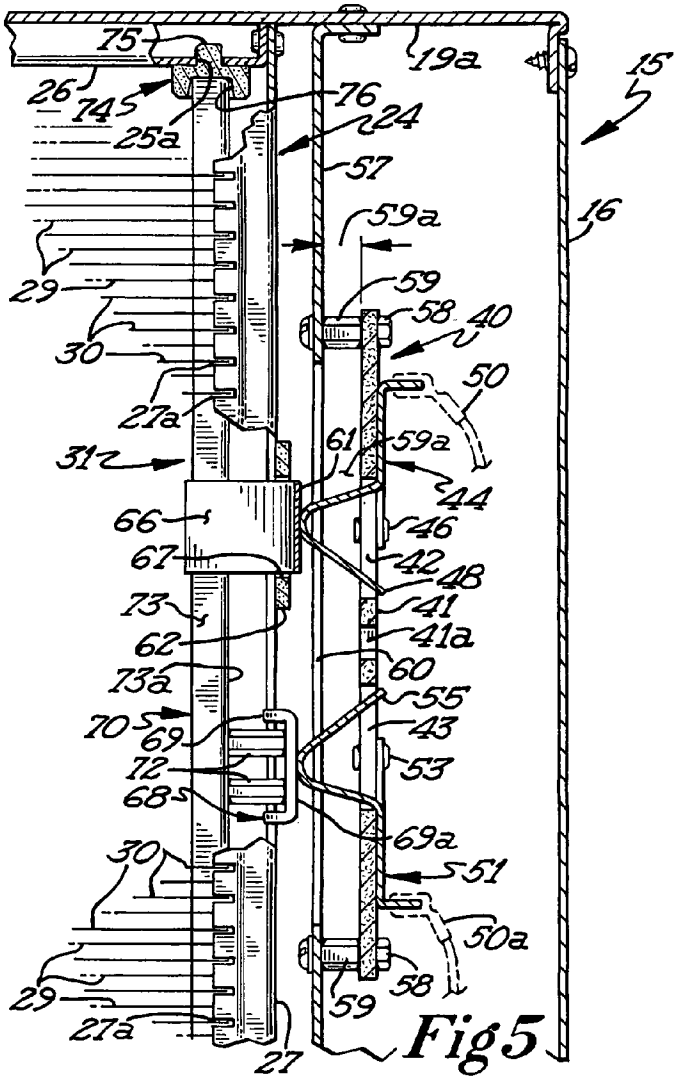
FIG. 5 is a cross-sectional view taken approximately along line 5-5 of FIG. 4 of the electrical contact assembly illustrating the manner in which the contact members of the contact assembly engage electrical contact elements on the precipitator cell.

Referring again to FIG. 3, it will be seen that a rectangular shaped contact element 61 is mounted on a rectangular shaped mounting element 62 which is formed of a dielectric material. The mounting element 62 is secured to the adjacent side rails 27, 28 of the precipitator cell by rivets 63 or other suitable fastening means. When the precipitator cell is moved into the cabinet, it will be seen (FIGS. 3 and 4) that the v-shaped contact portions 48 of the contact elements 44 will engage the contact member 61. The springy characteristic of the v-shaped portions assures good contact with the contact element 61. Referring now to FIG. 5, it will be seen that the contact element 61 is provided with an inner conductive strip 65 having a bent portion 66 which projects through an opening 67 in the mounting element 62. A rivet 63 secures the contact element 61 and its associated conductive strip 65 to the mounting element 62. The contact elements 61 and 65 may be formed of any yieldable conductive material, preferably phosphor bronze material. The bent portion therefore has a spring-like characteristic to assure effective contact with a plurality of the power fins 30. It will also be noted that the top rail 27 of the precipitator cell 24 has a plurality of slots 27*a* therein in which the power fins and ground fins project to assure proper positioning and spacing of the fins.

The contact elements 44 when connected to a source of electrical current supply current to the power fins 30. A rectangular shaped electrical contact element 68 having inturned flanges 69 is provided and is secured to an elongate channel shaped bus bar 70 by nut and bolt assemblies 71. The nut and bolt assemblies are provided with conductive standoffs or spacer 72 (FIG. 6) which position the contact member 68 such that its outer surface is disposed in the same plane as the outer surface of the contact member 61. It will be seen that when the precipitator cell 24 is slid into the cabinet, the contact elements 61 and 68 will be engaged by the v-shaped portion contact of elements 44 and 51. The curved surfaces defined by the inturned flanges 69 assures smooth interaction of the v-shaped portion 55 with the contact element 68 during the insertion of the cell into the cabinet. It is pointed out that the vertical spacing between the contact members 44 enables the v-shaped portions 48 to avoid engagement with the contact 68. The contact members 48 and 55 simultaneously engage the contact elements 61 and 68 respectively.

Figure 6:
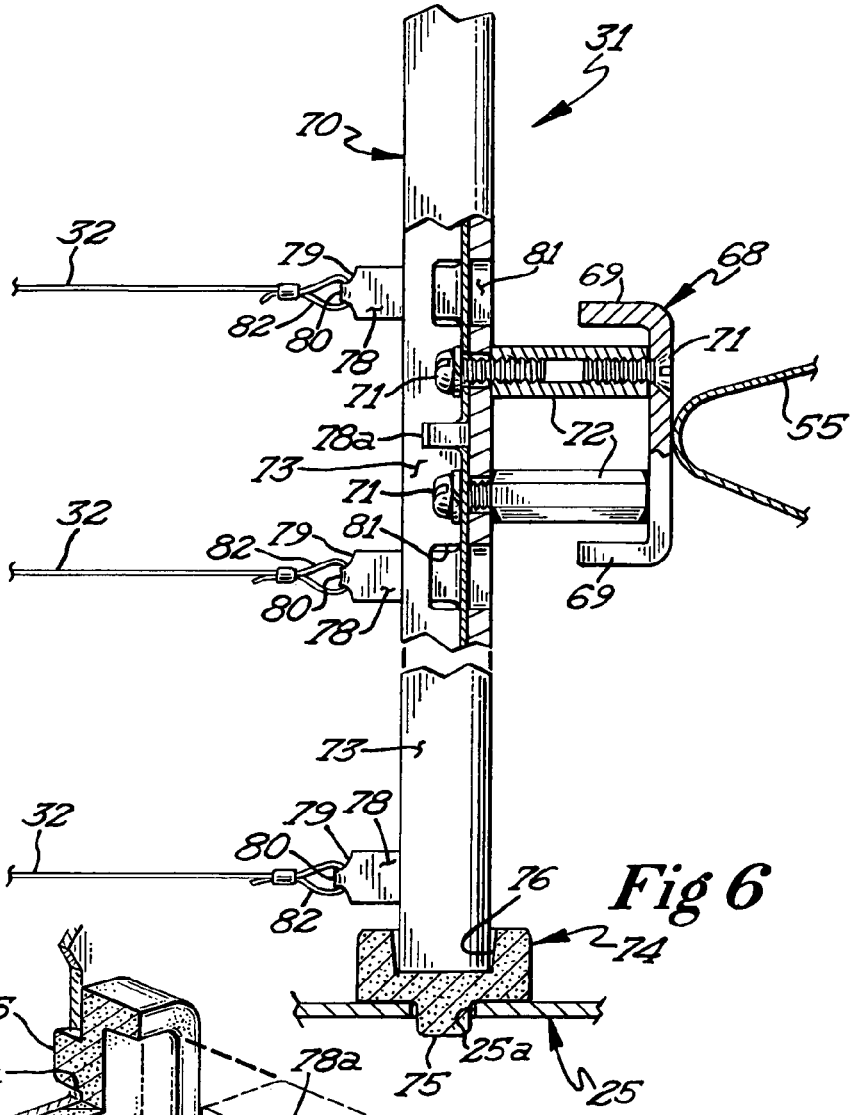
FIG. 6 is a fragmentary top plan view, partly in section, of the electrical contact member of the electrical contact assembly engaging the contact element for the ionizer grid.

Referring now to FIGS. 6 and 7, it will be seen that the bus bar 70 includes a web portion 73*a* integral with flanges 73. Both ends of the bus bar are positioned within and supported by ceramic cups 74 having small extensions 75 which projects through openings 25*a* in the front and rear walls of the precipitator cell frame.

Referring again to FIGS. 6 and 7, it will be seen that an elongate conductive strip 77 is mounted against the web 73*a* of the bus bar 70 and extends substantially throughout the length of the bus bar. The strip 77 is also flexible. The conductive strip 77 has a plurality of spaced apart fingers 78 extending downwardly therefrom through openings 81 in the lower flange 73 of the bus bar 70. The fingers 78 include angularly extending terminal portions 79 each having a hook 80 formed at its lower end. The strip 77 also has upwardly projecting fingers 78*a* integral therewith which engage the web and upper flange with frictional engagement.

Each ionizer wire 32 is provided with a loop 82 at its end for engaging a hook 80 of a finger 78. When electrical current is transmitted through the contact element 51 of the contact assembly, this current will be transmitted to ionizer wires. It is pointed out that a much higher voltage is transmitted to the ionizer grid than the power fins.

Figure 9:
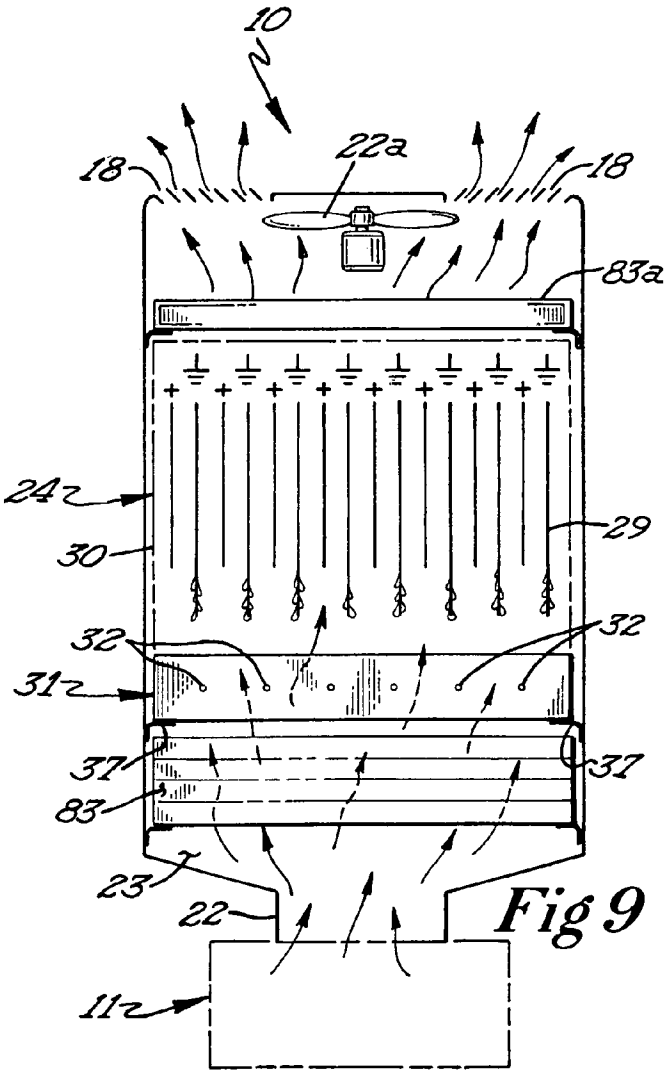
FIG. 9 is a diagrammatic view of the precipitator cell of the present invention also depicting the collector fins.

During operation of the electrical precipitator unit, air entrained coolant and particles will be moved through the inlet opening in the unit and machine tool and a substantial amount of coolant and particles will be removed when passing through the mist impingers 83. Air entrained coolant and particles will then pass upwardly through the ionizer grid and will be ionized and become charged. These charge carrying coolant and metal particles will collect and agglomerate on the ground plates (FIG. 9) and flow downwardly by action of gravity and drip from the ground plates. The ionized particles will be driven towards the ground fins by the charged fins. High voltage up to about 4,700 volts DC is required for the charged fins to repel the ionized particles against the adjacent ground fins. The high voltage required to ionize the particles passing the ionizer wires is up to 9,600 volts DC. Referring to FIG. 9 it will be seen that while drops agglomerate on the lower edge portions of the ground plates, the enlarged drops will not be able to extend across to the adjacent power fin. Therefore, this attendant problem of shorting to ground is minimized if not avoided altogether.

Figure 8:
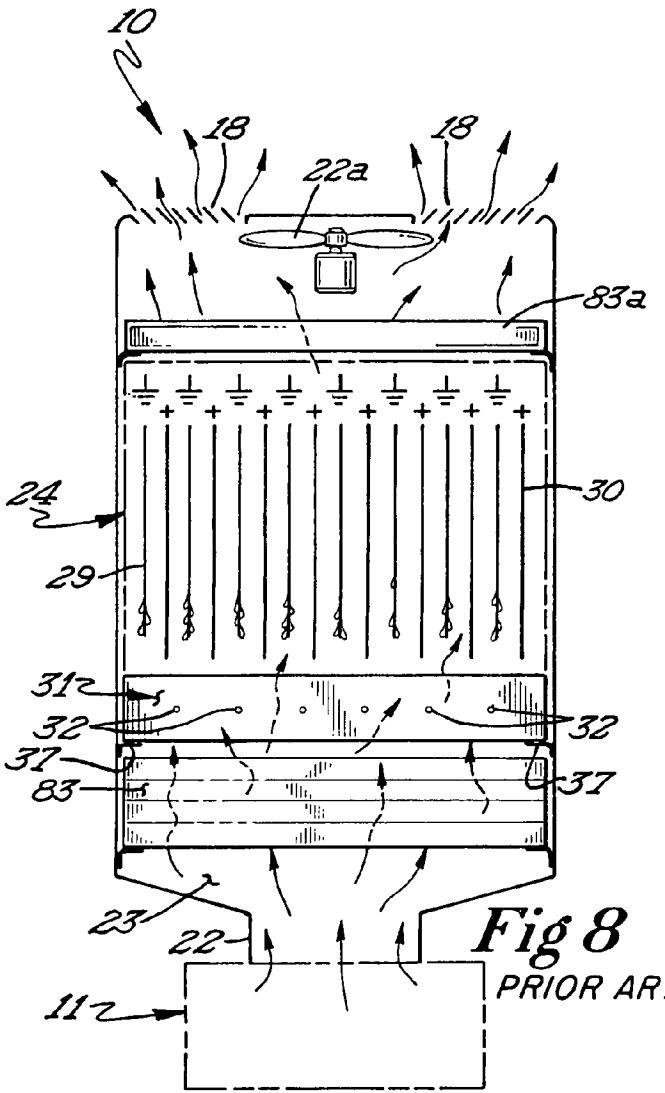
Fig 8 PRIOR ART
FIG. 8 is a diagrammatic view of a precipitator cell illustrating the collector fins in a conventional commercial cell or prior art cell.

The ionized charged particles are moved by the electromagnetic force generated by the charged fins towards the ground fins where particles (liquid, metallic, etc.) collect. In commercial prior art units (FIG. 8), the charged fins extend below the ground fins. The purpose of this design was to start the ionized particles moving towards the ground plates of the collector as the particles moved upwardly from the ionizer. However, this arrangement created the problem of the globules extending across and contacting the charged fins.

In the embodiment shown, electrical contact members for supplying current to both the ionizer grid and the power fins of the precipitator cell are components of the same assembly. This is the preferred embodiment even though separate assemblies for the ionizer grid and the power fins can be provided. The dielectric standoffs, the isolating air gap and the enlarged opening 60 in the inner wall are of crucial importance in minimizing tracking to ground by liquid. The electrical contact members 44 are electrically insulated from the electrical contact member 51 for the ionizer grid. The slot 41*a* in support member 41 minimizes, if not eliminates, the tendency of a high voltage spark jumping across to the contact member 44 when the support member becomes moist.

It is pointed out that in the embodiment shown a unit having a single precipitator cell is disclosed, larger units having several electrostatic precipitator cells are also subject to the same problem of shorting to ground by liquid tracking. Therefore, each cell in a multi cell unit will be provided with its electrical contact assembly having standoffs to provide the important isolating air gaps.

It will be seen that by providing the precipitator cells with shorter power fins relative to the collector ground fins and by providing air gap defining standoffs for the electrical contact assembly, applicant has provided a precipitator cell(s) which substantially avoids tracking to ground by liquids.

What is claimed is:

1. An electrostatic precipitator unit for the use with a machine tool for removing liquid coolant and particles generated during operation of the machine tool, comprising a rectangular shaped cabinet having exterior vertical walls, a bottom wall and a grill defining the upper portion thereof, a fan mechanism mounted interiorly of the cabinet adjacent the grill for producing a vertical stream of air, and an air inlet in the bottom wall thereof through which a vertically directed air entrained stream containing coolant and particles pass, one of the vertical walls of the cabinet having an access door thereon for providing access to the interior of the cabinet, a rectangular shaped electrostatic precipitator cell positioned in the cabinet and being readily moveable into and out of the cabinet, said cell including a plurality of similar vertically disposed power fins and similar vertically disposed collector ground fins mounted thereon, said power fins and ground fins being arranged in alternating fashion, an ionizer grid including a plurality of spaced apart ionizer wires positioned below the power and ground fins, an electrical contact assembly including a dielectric support member, a pair of electrical contact members mounted on the support member and one contact member being connected to a source of high voltage electric current and the other contact member being connected to source of higher voltage current, means mounting the support member on the cabinet interiorly thereof including dielectric standoff elements spacing the support member from the cabinet and defining an insulating air gap between the support member and any ground medium, and a pair of electric contact elements on the cell each engaged by one of the contact members, one contact element electrically connected to the ionizer grid and the other contact member electrically connected to the power fins.

2. The electrostatic precipitator unit as defined in claim 1 wherein each contact member is formed of a conductive spring material and includes a generally v-shaped portion for engaging the associated contact element on the cell.

3. The electrostatic precipitator unit as defined in claim 2 wherein each contact element on the cell has a substantially flat planar configuration and is frictionally engaged by the v-shaped portion of the associated contact member.

4. The electrostatic precipitator unit as defined in claim 1 wherein the lower edges of the power fins are spaced above the lower edges of the collector ground fins whereby fluid drops agglomerating on the lower edge portions of the collector ground fins cannot contact the lower edge portions of the power fins.

5. The electrostatic precipitator unit as defined in claim 1 and an elongate flexible conductive strip of said cell having a plurality of longitudinally spaced apart fingers extending therefrom, said strip being electrically connected to a contact element on the cell, each finger engaging one of the ionizer wires for supplying high voltage current thereto.

6. The electrostatic precipitator unit as defined in claim 1 wherein said other contact element on the cell includes a flexible portion which frictionally engages the edges of a plurality of power fins for supplying current thereto.

7. The electrostatic precipitator unit as defined in claim 1 wherein the means mounting the support member on the cabinet comprises an inner vertical wall spaced inwardly of the adjacent vertical wall of the cabinet, said inner wall having an opening therein only slightly smaller than the support member whereby the contact member are spaced from the inner cabinet wall.

8. The electrostatic precipitator unit as defined in claim 1 wherein the dielectric standoff elements comprise nylon sleeves.

9. The electrostatic precipitator unit as defined in claim 2 wherein said support member is of generally rectangular configuration having a plurality of openings therein, each contact member mounted adjacent an opening in the support member whereby the v-shaped portion of a contact member projects through an opening in the support member.

10. The electrostatic precipitator unit as defined in claim 1 and an elongate channel shaped bar formed of conductive material mounted on the cell and electrically connected to a contact element, an elongate flexible conductive strip positioned within the channel shaped member and having means for frictionally engaging the channel member for retaining the strip therein, a plurality of longitudinally spaced apart fingers extending from the strip, each finger engaging one of the ionizer wires for supplying high voltage current thereto.

11. An electrostatic precipitator unit for use with a machine tool for removing liquid coolant and particles generated during operation of the machine tool, comprising a rectangular shaped cabinet having vertical exterior walls and a grill defining the upper portion thereof, a fan mechanism mounted interiorly of the cabinet adjacent the grill for producing a vertical stream of air, an air inlet in the bottom wall thereof through which a vertically directed air entrained stream containing coolant and particles pass, one of the vertical walls of the cabinet having an access door thereon for providing access to the interior of the cabinet, a rectangular shaped electrostatic precipitator cell positioned within the cabinet and being moveable into and out of the cabinet, said cell including an ionizer grid including a plurality of spaced apart ionizer wires, said ionizer grid being connected to a source of high voltage electric current for ionizing the liquid coolant as the liquid coolant and particles move upward past the ionizer wires, said cell including a plurality of similar vertically disposed power fins and a plurality of similar vertically disposed collector ground fins mounted thereon, and connected to a source of electric current, said power and ground fins being positioned above the ionizer grid such that the ionized liquid coolant and particles collect on the collector ground fins, and the lower edge portions of the power fins being spaced above the lower edge portion of the collector ground fins whereby droplets agglomerating on the lower edge portions of ground fins cannot extend across to contact adjacent power fins.

* * * * *